United States Patent [19]

Magnes

[11] Patent Number: 4,706,310

[45] Date of Patent: Nov. 17, 1987

[54] LIQUID LEVEL CONTROL SYSTEM

[76] Inventor: Herbert Magnes, 2611 Obelisco Place, Carlsbad, Calif. 92008

[21] Appl. No.: 922,414

[22] Filed: Oct. 23, 1986

[51] Int. Cl.[4] ..... E04H 3/18

[52] U.S. Cl. ..... 4/508; 137/400

[58] Field of Search ..... 4/508, 496; 137/400, 137/389, 390, 443, 433, 614.19

[56] References Cited

U.S. PATENT DOCUMENTS

| | | | |
|---|---|---|---|
| 2,068,138 | 1/1937 | Johnson | 137/400 |
| 2,401,312 | 6/1946 | McCarty | 137/400 |
| 4,592,098 | 6/1986 | Magnes | 4/508 |

*Primary Examiner*—Henry J. Recla
*Assistant Examiner*—L. J. Peters
*Attorney, Agent, or Firm*—Frank D. Gilliam

[57] ABSTRACT

The invention is directed to a liquid level control system which can be installed within an automatic pool reservoir surface skimmer or separately within or external of the reservoir which includes a primary float valve which allows liquid to flow into a pool reservoir when the level of fluid in the reservoir falls below a first predetermined level and a secondary float valve associated with the primary flow valve which shuts off the flow of liquid into the pool reservoir when the level of the liquid exceeds a second predetermined level which is higher in elevation than the first predetermined level. The primary float valve continually operates between open and closed states. The secondary valve is normally in an open state and when caused to change to a closed state remains in a closed state until manually reset. A flow valve is included which terminates flow from the source of the liquid under pressure to the reservoir through the liquid level control system when a normally expected flow rate is exceeded. A novel triangular shaped supply line for liquid under pressure is provided for reservoir level control add on. Several different liquid supply line embodiments are shown.

18 Claims, 11 Drawing Figures

LIQUID LEVEL CONTROL SYSTEM

BACKGROUND OF THE INVENTION

This invention relates to the liquid level control art, and more particularly, to apparatus for maintaining the water level in a swimming pool, spa or the like within predetermined maximum and minimum levels.

The water level within a swimming pool, spa or the like should be kept within a rather narrow range of elevation level change in order that the skimming portion of the recirculating and filter apparatus will function properly. This level is usually maintained by simply observing the water level and supplying makeup water from a line source with a manually operated valve. However, because the volume of water necessary to make up even a slightly lower level is considerable, the time necessary to bring the water to the desired level may be several hours, a circumstance which renders the task unpleasant and additionally, brings about the possibility of over filling due to failure to monitor the progress of the operation carefully enough. Thus, it will be apparent that it would be highly advantageous to provide automatic means for maintaining the water level of swimming pools or like liquid reservoirs within predetermined maximum and minimum levels without the need for manual supervision or intervention which includes a fail safe back up system incorporated therein to prevent overfill if the automatic system fails while in the fill mode.

There are numerous automatic fill systems in the art directed to fill control of swimming pools and the like. These systems generally utilize float valve means to control the flow of new or additional water into the reservoir. These systems employ either mechanical or electrical valve control means responsive to float vertical position. Although most of the prior art devices use a single liquid input control valve associated with a float, some prior art devices include a reservoir within the valve means separating input and output conduits and includes a float actuated valve in both the input and output conduits whereby a single leaking valve will not cause over filling of the swimming pool or reservoir.

U.S. Pat. No. 2,068,138 teaches a two stage float actuated valve system utilizing a pair of internal reservoirs each with a float and valve for controlling the flow of liquid into the reservoirs. One float and valve combination is the primary liquid flow control valve and the second acts as a backup in the event the primary valve fails to close off liquid flow into the reservoirs. Both valves are actuated between open and closed states.

In my U.S. Pat. No. 4,592,098 issued on 06/03/86, I have advanced the pool reservoir fill control art by providing a level control device that is satisfactory for the purpose intended; However, in my prior art device resetting of the secondary or safety over fill valve required shutting off the liquid supply line and then bleeding the liquid under pressure from the line causing inconvience if an overfill of the pool reservoir should occur preventing practical use of the device when installed in pool reservoir cleaners known in the industry as surface skimmers. Further, it was found on occasion that the primary float which operates the normal fill and level maintenance of the pool reservoir has a tendency to occasionally bind on the housing adjacent thereto preventing the desired pool reservoir level maintenance.

SUMMARY OF THE INVENTION

The automatic valve system of the present invention includes a primary valve float valve and a secondary or back up float activated valve positioned within the flow tube to the primary float valve. In the event of overfill of the pool or the like by a liquid passing through the primary float valve due to operation failure, the secondary or backup valve is activated from its normally biased open position to a closed position preventing liquid flow through the flow tube of the primary valve. The pressure from the liquid source, generally in the range of 20 to 110 pounds, holds the secondary or backup valve when in a closed state until the pressure is removed and the liquid level in the reservoir is at the desired level allowing the valve operated float to return the valve by gravity to its open state.

The level control system may be mounted within a conventional pool surface skimmer which is fixedly mounted in the side of the pool and extends into the pool water. The surface skimmer includes an opening to the reservoir surface with a pivotal door in the opening and a suction line from a pump for removing surface debris. The level control system when mounted within the surface skimmer is height adjustable relative to the surface skimmer. The floats for the two valves are contained in a semi-enclosed chamber. The chamber is substantially enclosed to prevent surface water action from affecting the operation of the floats. At least one small aperture allows the pool liquid to enter the semi-enclosed chamber. The upper portion of the chamber is sufficiently vented to allow the water level therein to be equal to the normal surface level of the pool. A first valve, one end of which is connected to a hose or line through the second valve from a source of liquid under pressure and the other end positioned over the surface of the pool, is operated by a first float which operates the first valve between an open state when the pool level is below a first predetermined level and a closed state when the first predetermined level is reached or exceeded. By positioning the liquid output of the device above the pool surface the sound of water passing through the system when the system is operating in the reservoir fill mode is audible. In the event that the first valve fails to achieve its closed state when the level reaches or exceeds the first predetermined level and the pool level increases to a second predetermined level, a level greater than the first predetermined level, the second or backup valve changes from its normally open state to its closed state terminating the flow through the inoperative first valve. The weight of the second valve operating float holds the valve in its normally open state when the first valve functions normally. The weight of the freely hanging second valve operating float is overcome by the liquid raising the float level when the level of the liquid in the pool reaches the second predetermined level causing the valve to close off liquid flow. Once closed, the valve remains closed by the pressure from the liquid source regardless of the position of its associated float. The secondary valve can be reset only when the water pressure is removed by venting the internal valve chamber of the second valve to the atmosphere and reduction of the pool water level below the second predetermined level.

The hose of line connection from the source of liquid under pressure can be concealed by extending the hose or line through the suction line of the surface skimmer to which it is attached.

A flow shut off valve may be installed in the liquid supply hose or line remote from the reservoir to shut off the flow of liquid to the level control system if the flow through the hose or line exceeds an expected flow rate, for example, if the hose or line should break downstream of the flow shut off valve or become disconnected from the level control system in a location undetectable by visual observation.

In after initial reservoir construction installation or add on of the flow level control system, a novel liquid supply hose or line is utilized. This supply hose or line has a smooth outer surface and is shaped in the form of a triangle. These features prevent the unwanted grasping of the hose by children or the like. The hoses flat surface is adhered to an available vertical reservoir flat surface. The central portion of this triangular hose is tubular resembling a conventional hose.

There are several ways shown for connecting the source of liquid under pressure to the liquid control system in addition to these aforementioned. A few of these ways of connecting include, but are not limited to, running the hose or line through the skimmer door to the pool and then along a vertical wall of the pool to the supply source; through plumming within the pool deck; through the surface skimmer lid plumed as before mentioned or connected to a common garden hose.

The first valve is designed so that a float actuation rod extends longitudinally from the float externally of the bottom of the housing containing the level control system so that when the level control system is removed from the reservoir level influence and place on a flat surface the second valve is closed terminating liquid flow from the attached hose to the first control valve. This feature allows persons cleaning or performing maintainance to remove the level control system from its operative location to the deck of the reservoir for skimmer service, examination, etc., without closing a separate valve in the supply line to the device. The first valve automatically returns to its normal operating condition when the level central system is returned to its operating location.

Although the expected use of the level control system of the invention is in conjunction with a surface skimmer the device is not so limited. The device of this invention can be installed in a container located remote from the reservoir with a liquid level sensing line connected between the reservoir and the container whereby the liquid level in the container is representative of the level of liquid in the reservoir.

The entire level control system is mechanically operated and does not include the need of any unsafe electrical connections for its operation.

An object of this invention is to provide a fail safe automatic fill system for a liquid reservoir which is adaptable for mounting internal of a conventional pool surface skimmer.

Another object of the invention is to provide an automatic liquid reservoir fill system that terminates liquid flow into the reservoir in the event of control failure.

Still another object of the invention is to provide an automatic fill system for a liquid reservoir which can be easily manually reset externally of the system when valve failure occurs and the flow of liquid to the reservoir is terminated.

Yet another object of the invention is to provide an automatic and fail safe liquid reservoir fill system which can be used on existing pool surface skimmer installations which requires no modification to the skimmer or reservoir.

Yet another object of this invention is to provide an automatic and fail safe liquid reservoir fill system which all of the necessary external connections are concealed.

Yet another object of this invention is to provide a means for terminating liquid flow to the device in the event that a supply line should break or become disconnected at a location visually unobservable.

Yet a further object of this invention is to provide a means of terminating liquid flow through the device of the invention when the device is removed from its operating location and placed on a support surface.

Yet a further object of this invention is to provide a supply line configuration that can be installed in previously constructed reservoirs which can not be grasped by children or mischievous persons.

Yet a further object of this invention is to feed the supply line through the vacuum line of a surface cleaning device.

Yet a still further object of this invention is to eliminate the need of any electrical connections.

Still other objects and advantages of the present invention will be appreciated from the details of construction and operation set forth in the accompanying specifications, claims and drawing figures.

BRIEF DESCRIPTION OF THE DRAWINGS

The features of the present invention which are believed to be novel are set forth with particularity in the appended claims. The invention, together with the further objects and advantages thereof may best be understood by reference to the following description, taken in conjunction with the accompanying drawings. In the drawings, like reference numerals identify like elements in the several Figures in which:

DETAILED DESCRIPTION OF THE PREFERRED EMBODIMENT

Figure 2:
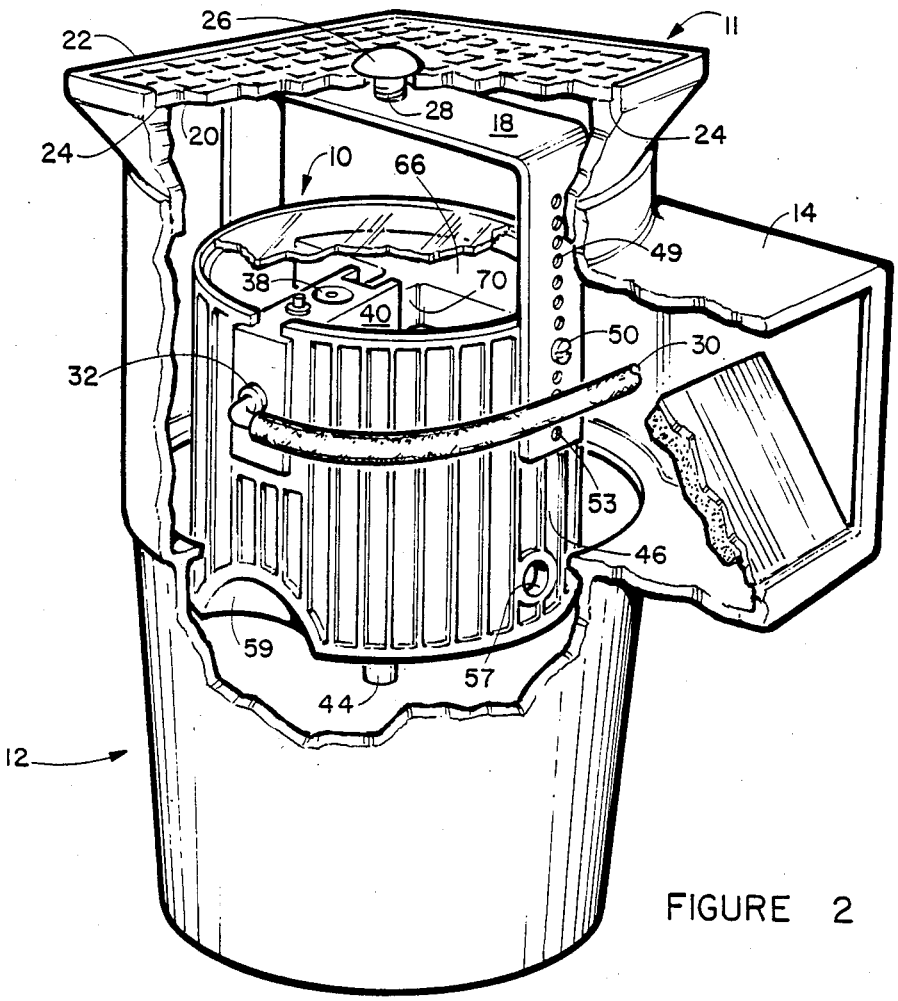
FIG. 2 is a schematic showing in cut-away of the relationship of the floats and associated valves of the present invention, installed in a conventional pool surface skimmer.
Figure 1:
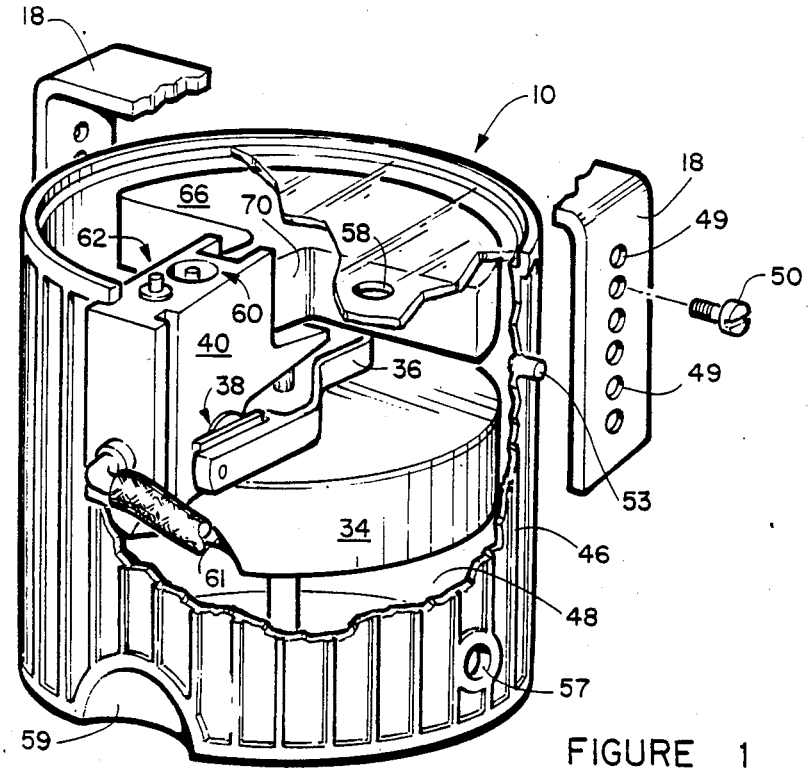
FIG. 1 is a perspective partial cut away showing of the automatic fill valve system of the present invention.
Figure 3:
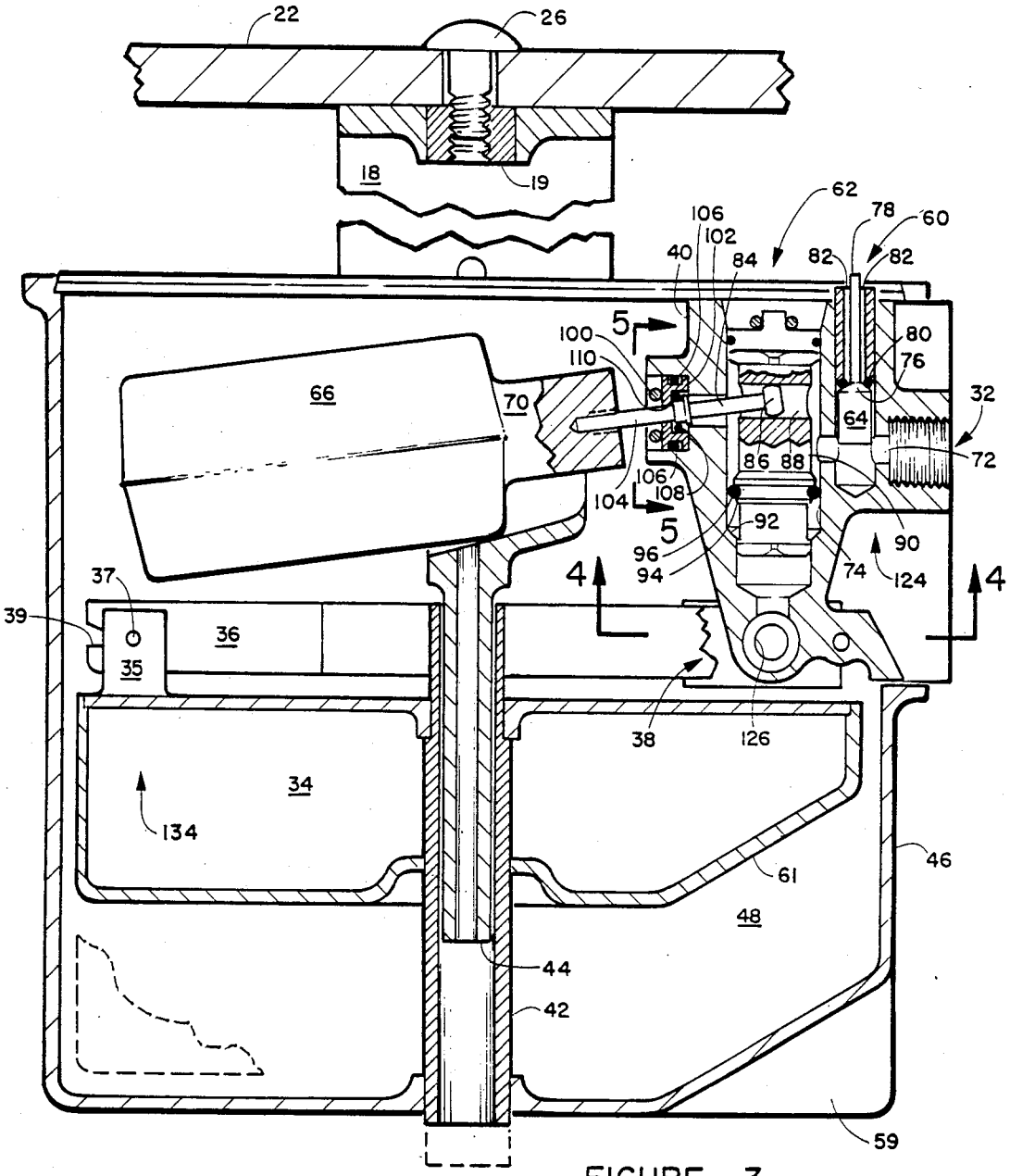
FIG. 3 is a cut-away showing of the detailed of the mechanisms of the invention.

In the illustrations given and with reference first to FIGS. 1, 2 and 3 the numeral 10 designates generally a liquid level control system which is shown installed within a surface skimmer 11 which includes a surface opening 13 and a closure door 15 for use with a liquid reservoir or swimming pool or the like (one example shown in FIG. 11) having attachment 14 at the edge thereof. The liquid level control system 10 includes a mounting bracket 18 which attaches the device to the under surface 20 of the cover 22 of the surface skimmer 11. Surface skimmer cover 22 is mated to the surface skimmer by means of recess 24. The bracket 18 attaches to cover 22 by bolt 26, the shank of which is threaded into threads 28 of bracket 18 and may include a nut 19 (see FIG. 3). A hose 30 is attached to a pressurized supply, not shown, municipal or otherwise and extends to a pressure sealed connection at the system inlet 32 by conventional and known means. The hose 30 is shown forming a partial loop around the side surface of the valve chamber. Additional loop length may be required for some installations. This loop allows the chamber to be positioned up or down relative to the fixed in place surface skimmer, as hereinafter described, without affecting the hose connection. The hose can also be connected to the system inlet via a pivotal mechanical connection, not shown.

The primary valve float 34 is attached through float extension 35 and pin 37 to an end slot 39 of an actuating yoke 36 which operates a primary valve 38 located near the bottom of housing 40. The float is guided in its linear up-down movement by means of a central aperture 42 which is received in and guided by a downward extending rod 44, (see FIG. 3).

A housing 46 is substantially enclosed to form a float chamber 48 which height adjustably mates with the surface skimmer. The housing 46 is vertically adjustable relative to the liquid level control system via selected apertures 49 in bracket 18 to accommodate different pool liquid level to surface skimmer distances so that the floats that operate therein are properly located with respect to the desired pool liquid level. By the removal of the cap screw 50, the housing 46 can be height adjusted relative to the surface skimmer housing 52, by mating of a pair of selective apertures one with the cap screw 50 and the other with dimple 53. After a selected height adjustment the re-tightening of the cap screw locks the relative position of the housing and bracket 18. The housing 48 has at least one side aperture 57 to allow sufficient water to enter the float chamber 48 to maintain pool liquid level therein and yet small enough to prevent liquid surface movement from affecting the operation of the float 34. Upper surface openings 58 (one shown) allow for venting. In installations requiring vacuum hoses from the cleaning devices require a notch 59 through housing 46 and a tapered adjacent edge 61 on float 34.

A reset valve 60 and a secondary valve 62 (see FIG. 3) are located within the housing 40 and positioned in series between the primary valve 38 and system inlet 32. A manually operated reset plunger 64 operates reset valve 60 and a secondary float 66 is attached to and operates the secondary valve 62 through a float arm 70 which actuates the valve (as hereinafter discussed).

Referring now specifically to FIG. 3, the reset valve 60, shown in cut away, the valve includes a reset valve chamber 72 which connects to the water under pressure from hose 30 and provides an open passage between hose 30 and the chamber 74 of the secondary valve 62 when in the open position as shown. Within the reset valve chamber 72 is the reset pluger 64 with an elongated extension 78 extending through the upper housing surface. The edge of the upper surface 76 of the valve member is formed at an angle to mate with an "o" ring gasket 80 positioned between the upper surface 76 of the reset plunger and with an upper smaller dimension portion of chamber 72 which narrows to conform to the elongated extension 78. The "o" ring and smaller chamber portion seal any liquid from exiting out the space 82 between the housing 40 adjacent the elongated extension. When the elongated extension is manually depressed downward against incoming liquid pressure, the flow through the reset chamber is closed preventing flow into the chamber 74 of the secondary valve 62 and liquid under pressure in the chamber 74 is vented to atmosphere through space 82.

Figure 5:
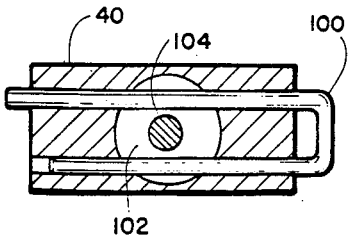
FIG. 5 is a showing taken along line 5—5 of FIG. 3.

The valve housing 40, shown in cut-away, includes the secondary valve 62 and its operating mechanism. Float arm 70 is elevated from primary float 34 as is float 66. The float arm 70 includes an enlarged end 84 supporting a bearing 86 constructed of lubricious material such as Teflon° brass or the like. The bearing 86 rides within recess 88 of a valve plunger 90. The housing 40 further includes a valve seat 92 configured to receive the enlarged head 94 of valve plunger 90 and form a sealing relationship with an "O" ring 96 carried by the enlarged head 94. When the secondary float 66 is positioned above the water level in the bottom of housing 46, the weight of the float and the liquid pressure within the housing prevents the enlarged head 94 of the valve plunger 90 from nesting in the valve seat 92, thus allowing the liquid under pressure from a secondary chamber 74 to pass around the secondary valve plunger 90. The secondary valve plunger 90 is shown spaced from walls 98 of secondary chamber 74 which allow water flow through flow chamber 74 when primary valve 38 is in an open state (see FIG. 7). A spring clip 100 passing through aperatures in the side wall of housing 40 holds a seal block 102 within recess 104 in housing 40 and is sealed thereto by "O" ring 106 and 108. The seal block 102 holds enlarged end 84 of floatation arm 70 within bearing 86 in operable positions. The "O" ring 108 operably associated with the enlarged end 84 and prevents leakage of fluid through an arm aperture 110. Details of the clip and seal block are shown in FIG. 5. Rod 44 which guides float 34 is itself translatable vertically relative to yoke 36 and extends through the bottom surface 48 of housing 46 when valve 62 is open to liquid flow. The valve 64 is configured so that when it is removed from the surface skimmer and placed on a support surface, such as the reservoir deck, it shuts off automatically rather than allowing liquid to continue to flow while the pool service person performs required service.

Figure 4:
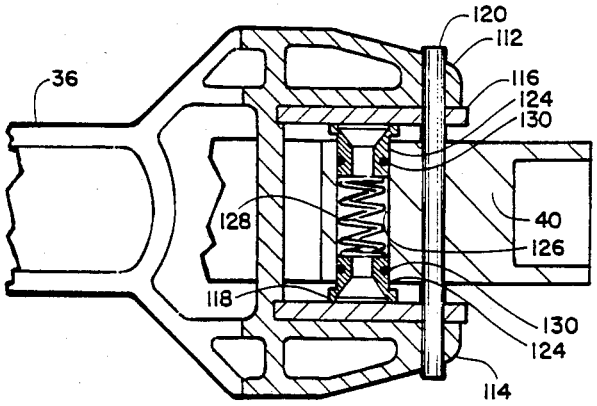
FIG. 4 is a showing taken along line 4—4 of FIG. 3.

Referring now specifically to FIG. 4, the inner side extensions 112 and 114 of yoke 36 are on parallel planes. The side extensions 112 and 114 are connected to seal plates 116 and 118 respectfully by means of pin 120 passing through aligned apertures in the arm and housing 40. The yoke is also held in the position shown relative to the housing by the pin 120 passing through the housing 40, end plates 112 and 114 and seal plates 116 and 118. A pair of shear seals 124 are inserted from each end of a transverse flow chamber 126. A coil spring 128 maintains outward pressure on the shear seals 124 by forcing them against seal plates 116 and 118 where they remain in a captive sealed relationship. The seal plates and shear seals can be constructed of any suitable material that will establish a smooth rotary sealed engagement. Materials such as Teflon, bronze or the like may be used.

A pair of "O" ring seals 130 are carried around shear seals 124 to prevent liquid leak through the transverse flow chamber 126 around the shear seals. As hereinafter explained, liquid flowing through the transverse flow chamber 126 exits through the chamber ends when the valve is rotated downward about pin 120 toward the pool surface and the ends are rotated partially free of seal plates 116 and 118 (see FIG. 7).

Figure 6:
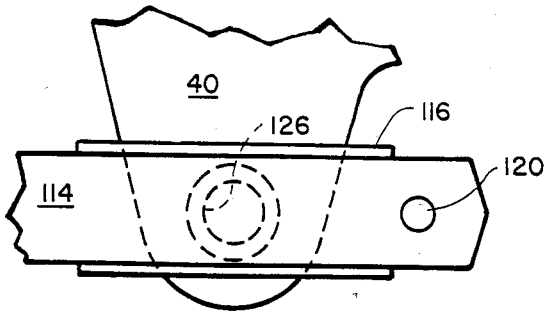
FIG. 6 is a partial cut-away showing of the operation of the first valve in its closed state.
Figure 7:
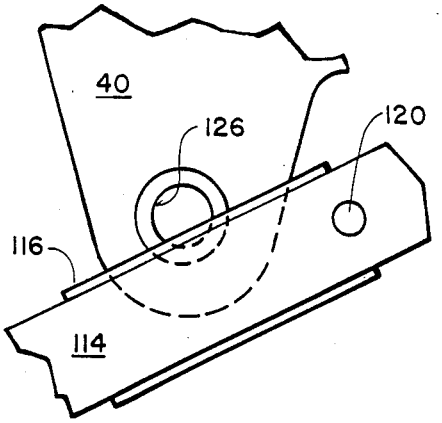
FIG. 7 is a partial cut-away showing of the operation of the first valve in its open state.

Referring now to FIGS. 6 and 7, FIG. 6 depicts the primary valve 38 in its closed position, i.e., the ends of the shear seals are sealed by seal plates 116 and 118 preventing liquid flow from chamber 74 through primary valve 38. FIG. 7 depicts the primary valve 38 in its open position, i.e., the ends of the flow chamber 126 are partly spaced from seal plates 114 and 116 (114 shown) allowing liquid to flow out and upward from the primary valve 38 through the ends of chamber 126. This flow of liquid upward can be heard external of the valve system.

It should be understood that the primary valve will continual, pivot about pin 120 between its FIG. 6 and 7 positions depending on liquid level thereby maintaining the liquid level of the reservoir at a first predetermined level. The secondary valve 62 remains open and inoperative as long as the first valve functions to maintain liquid lever in the reservoir in a normal expected manner up to the first predetermined level.

If the expected operation of the primary valve 38 is prevented for any reason by the primary valve sticking or remaining in an open condition for any reason allowing the liquid in the reservoir to reach a second predetermined level the secondary valve 62 will terminates the flow of liquid from house 30 into flow chamber 126. If valve 38 is stuck open for any reason water from hose 32 will continue to flow into the pool or reservoir thereby allowing the water level in the bottom chamber to rise, causing float 66 to rise along arrow 134 whereby bearing 86 will move downward depressing the valve plunger 88 downward causing it to seat. When the valve plunger is seated, the liquid pressure from hose 30 forces the valve plunger to remain seated even if the liquid level in the reservoir should return to or below its first predetermined level. With valve plunger 90 seated, liquid from hose 30 cannot now flow through the flow chambers 72, 74 and 126 into the reservoir regardless of the position of the primary float 34.

To re-initiate the flow of liquid through the control system, the pressure now in the flow chamber 74 must be removed and the water level in the reservoir must be at or below the first predetermined liquid level so that the weight of the float can translate the valve body upward along arrow 124 whereby the valve plunger 64 is repositioned to its normally open state as shown in FIG. 3. The flow pressure in chamber 74 is removed and liquid under pressure from hose 30 is terminated from entry into chamber by depressing the elongated extension 78 of the reset valve member 76 downward until the valve member is seated. This action disconnects the liquid under pressure from hose 30 from entering chamber 74 and vents the liquid under pressure trapped therein through space 82 external of the chamber, with the water level now below the minimum level of float 66 (as shown in FIG. 3) the weight of the float moves the float downward in the direction opposite to arrow 134 reopening valve 62.

Figure 8:
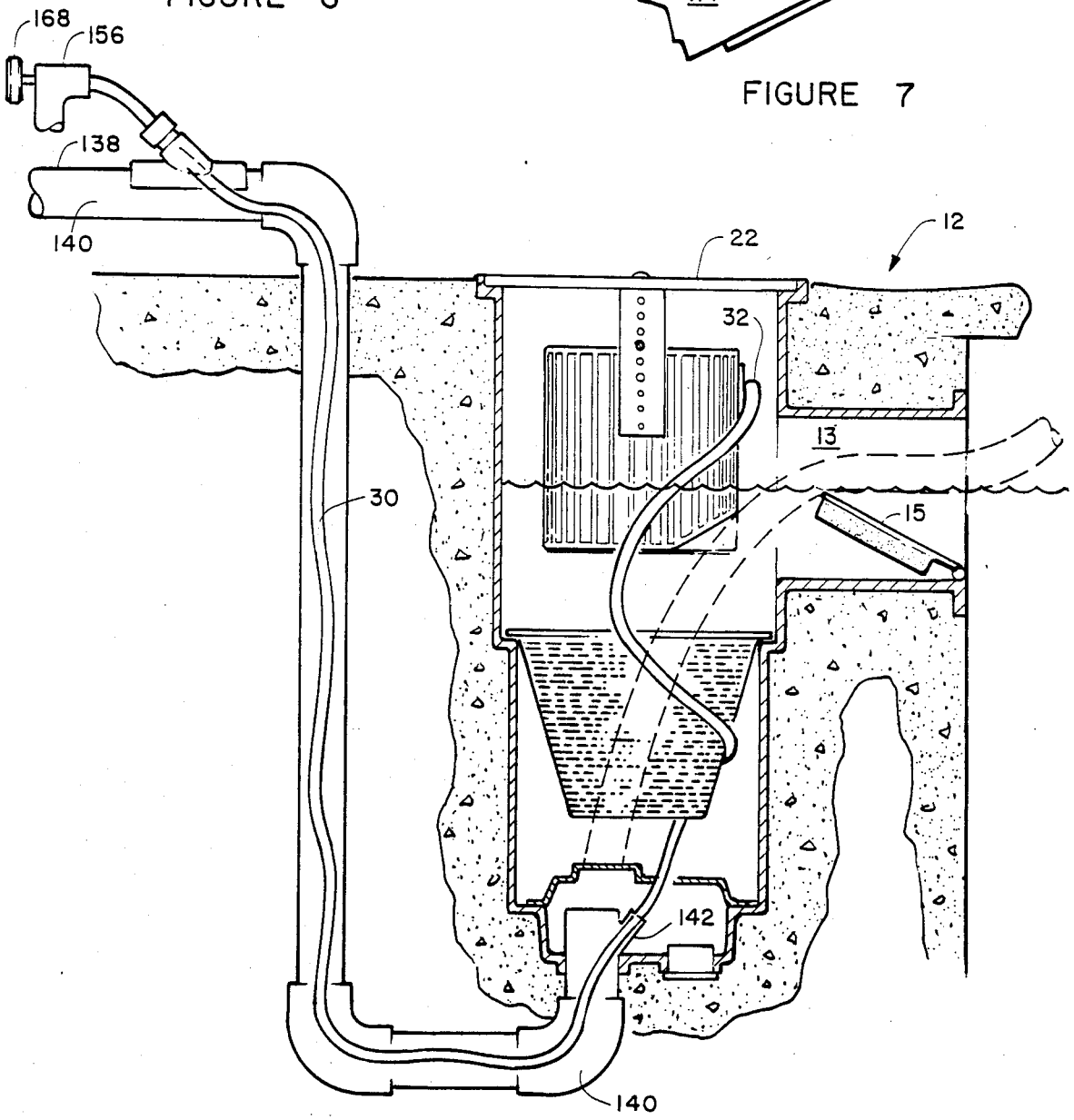
FIG. 8 depicts a cut away showing of the device of the invention installed in a surface skimmer with the source of liquid under pressure fed through the surface skimmer pump suction line.

FIG. 8 is a schematic cut away showing of the control device 10 installed in a surface skimmer 11 as shown in FIG. 2 in more detail. The hose 30 is shown extending through the wall 138 of the skimmer pump suction line 140 and has a sealed relationship therewith. An adapter 142 is shown. In this manner the hose is concealed within the suction line.

Figure 9:
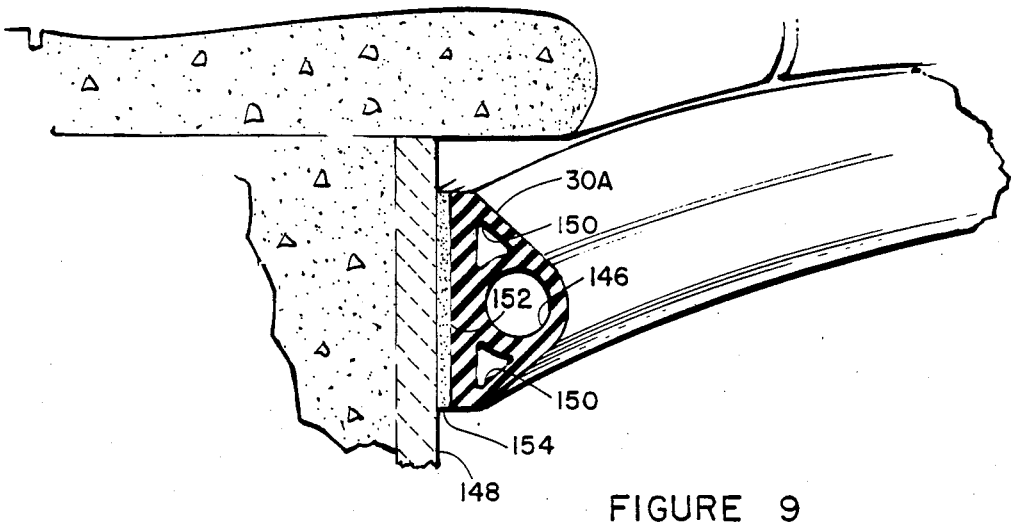
FIG. 9 is a perspective showing of a novel shaped liquid supply line.

FIG. 9 shows a hose 30A for supplying liquid under pressure to the liquid level control system 10 installed as an existing pool add on. This novel hose 30A is triangular in cross-section and includes a central tubular liquid supply opening 146. The outer surface of hose 30A is made exceptionally smooth so that it cannot be easily grasped by a child or the like and pulled away from its pool vertical wall 148 attachment. The hose can be solid except for supply opening 146 or may include triangular openings 150 there along. The flat surface 152 of the hose 30A is generally adhered by an adhesive layer 154.

Referring again to FIG. 8, an excess flow control valve 156 is placed along hose 30 in series with liquid flow there through between the fluid source and the liquid surface of the reservoir. The purpose of the excess flow valve is to terminate the flow of liquid through hose 30 when the flow of liquid through the hose exceeds a predetermined level flow rate for example, if, for example, hose 30 should burst or become detached from the control system 10 under the surface of the liquid were it could not be readily detected by visual observation. The flow valve 156 terminates flow when the expected flow rate is exceeded and must be manually reset to resume flow through hose 30.

Figure 10:
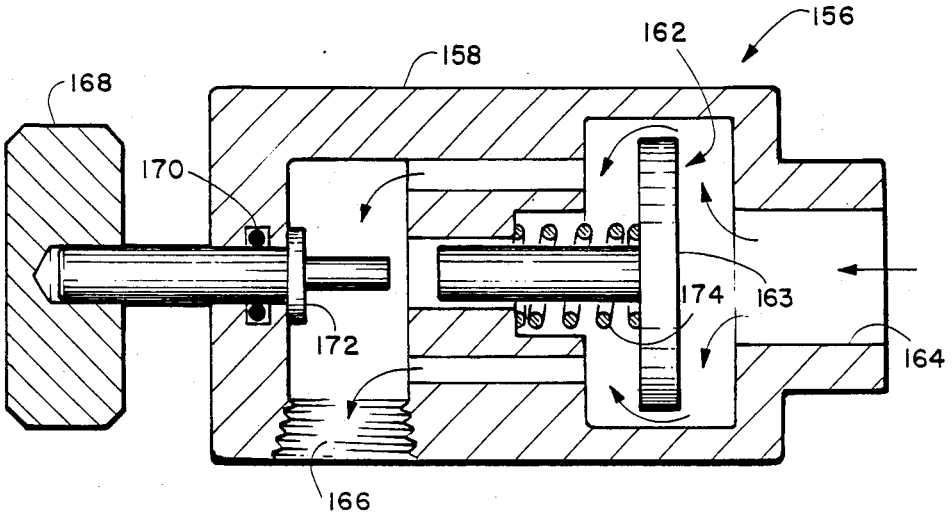
FIG. 10 is a cutaway showing of a flow cut off valve which may be installed in the liquid feed line remote from the device of the invention.

Referring now specifically to FIG. 10. FIG. 10 is a cross sectional schematic showing of the excess flow valve 156. The valve is contained in a housing 158 having a liquid through channel with a valve member 162 located intermediate the liquid input end 164 and the liquid exit end 166. A reset button 168 extends through the wall of housing 158 and is translatable relative thereto. An "O" ring 170 seals the reset button to housing 158. A flange 172 maintains the reset button in position. The valve member 162 is substantially "T" shaped in cross-section. The inner walls of the housing 158 engages the inner surface of the enlarged portion 163 of valve member 162 when flow is terminated due to excess flow. The valve member 162 is normally biased to an open position, away from the wall of housing 158 by a spring 174. In operation, the spring 174 has sufficient bias to hold the excess flow control valve in its open position shown in FIG. 10 when the flow of liquid as less force against the outer surface of the enlarged portion 163 than the force of spring 174. This is the condition that exists when the flow through hose 30 is as anticipated, ie. normal. When the hose 30 bursts or becomes disconnected to the liquid level control system the flow of liquid through the hose and excess flow valve increases, the bias of spring 174 will be overcome forcing the inner surface of the enlarged portion 163 to seat against the housing wall terminating flow through hose 30. The pressure of the liquid will then hold the excess flow valve closed until the reset button 168 is pressed inward again allowing liquid to flow trough the excess flow valve. The excess flow valve will then remain open until excess flow is again present.

Figure 11:
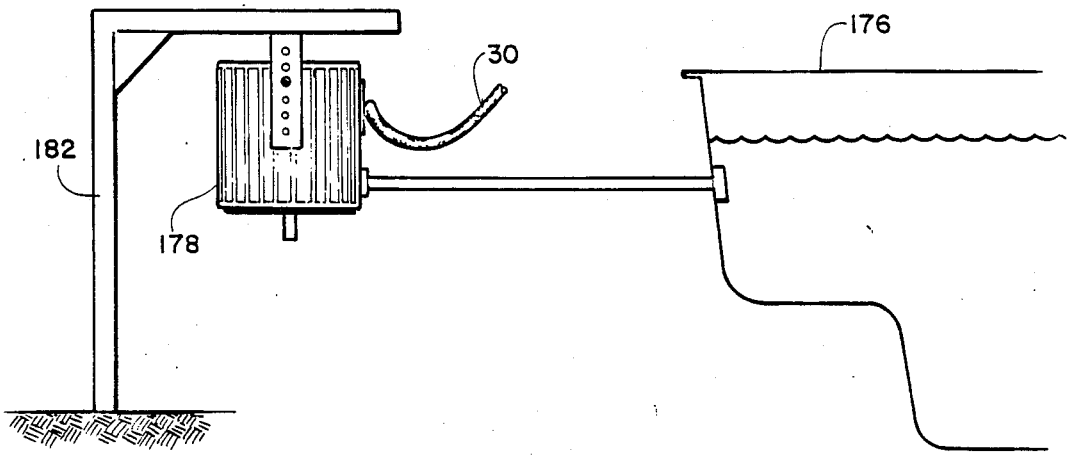
FIG. 11 is a schematic showing of the installation of the device of the invention remote from the reservoir the level of which it controls.

FIG. 11 is a schematic showing of a reservoir 176 with a liquid level control system 10 of the invention remotely located therefrom. The control system 10 is enclosed within an open vessel 178 the upper portion of which is open to the atmosphere. A liquid level sensing line or hose is connected between the reservoir 176 and the vessel 178 so that the level of liquid in the vessel will represent the level of liquid in the reservoir. The liquid level sensing system 10 operates in the same manner hereinbefore discussed. The vessel can be conviently supported by a post 182 or the like.

As should be understood, the automatic fluid control system is advantageous for maintaining reservoir fluid levels when unattended for long periods of time as the reservoir cannot be filled past the second predetermined level and valve problems, etc. will be readily noticeable and can be repaired prior to resetting and use.

It should be further understood that although the use and operation of the liquid level control system of the ignition is described herein for use with an existing reservoir or swimming pool, the device is not so limited and can be used in spas, hot tubs and the like where liquid levels are to be maintained.

While in the foregoing specifications, a detailed description of the invention has been set forth for purposes of illustration, the details herein given may be varied by those skilled in the art without departing from the spirit and scope of the invention as defined by the appended claims.

What is claimed is:

1. A liquid level control and safety fill system for use with a reservoir or the like comprising:

liquid feed line for providing liquid from a source of liquid under pressure for adding liquid to said reservoir for maintaining a predetermined liquid level in said reservoir;

a first valve means in series between said source of liquid under pressure and said reservoir, said first valve means rotatably operable between open and closed states, said open state allows liquid to flow from said source under pressure into said reservoir and said closed state terminates said flow, the state of said first valve is determined by the liquid level in said reservoir;

a second valve means is connected in series between said source of liquid under pressure and said first valve means, said second valve means is operable between a normally open state and a closed state, said second valve means changes from its normally open state to its closed state when said predetermined liquid level is exceeded and is held in said closed state by said liquid under pressure until reset; and reset means for manually resetting said second valve means from a closed state to an open state, said reset means is positioned in a series between said liquid under pressure and said second valve means, when activated said reset means seals said liquid under pressure from entering said second valve means and vents the liquid under pressure trapped between said reset means and said second valve means to atmosphere causing said second valve means to change from a closed state to its normally open state when said liquid level in said reservoir is at or below said predetermined level.

2. The invention as defined in claim 1 wherein said liquid level control and safety fill system is housed in a reservoir surface cleaning device which is fixedly attached to said reservoir, said surface cleaning device includes an opening to the surface of said liquid and said opening includes a door the opening of which is controlled by the level of liquid in said reservoir.

3. The invention as defined in claim 2 wherein said liquid level control and safety fill system is vertically adjustable relative to said surface cleaning device to accommodate a range of predetermined liquid level heights in said reservoir.

4. The invention as defined in claim 2 wherein said housing includes openings in its submerged portion so as to maintain substantially the same liquid level in said housing as in said pool reservoir.

5. The invention as defined in claim 1 wherein said first and second valve means are float operated.

6. The invention as defined in claim 1 wherein said first valve means comprises a central housing with an opening therethrough for the flow of liquid under pressure when said valve is open, a yoke having seal plates rotatable relative to said housing , a float connected to said yoke for varying the rotational position of said yoke responsive to the level of said liquid in said pool reservoir, said seal plate having an opening communicating with said opening in said housing when the level in said pool reservoir is less than said first predetermined level.

7. The invention as defined in claim 6 wherein said first valve further comprises shear seals biased against said yoke to seal off any flow of liquid under pressure when said level in said pool reservoir is at or greater than said first predetermined level.

8. The invention as defined in claim 1 wherein said second valve means comprises a float operated valve member and a valve seat positioned intermediate the source of fluid and said first valve means, a float the weight of which biases said valve member away from said valve seat when said second valve is in an open state, allowing said liquid to flow around said valve member and into said first valve means, when the level of said pool reservoir exceeds said second predetermined level of liquid in said pool reservoir said float of said second valve means is elevated causing said valve member to contact said valve seat closing said second valve means, whereby the pressure of said liquid under pressure maintains said second valve means in its closed state.

9. The invention as defined in claim 2 wherein said reservoir surface cleaning device includes a pump suction line for removing surface debris and said feed line is positioned at least partially within said pump suction line.

10. The invention as defined in claim 1 additionally comprising a flow valve positioned between said source of liquid under pressure and said reservoir, said flow valve is normally open whereby an expected rate of liquid flow into said reservoir occurs, said flow valve closes preventing flow of liquid into said reservoir when said rate of liquid flow exceeds said expected rate of flow.

11. The invention as defined in claim 10 wherein said flow valve maintains said closed condition until manually reset, said flow valve comprises external means for manually resetting said valve from closed to open.

12. The invention as defined in claim 1 wherein said feed line positioned external of said reservoir and is substantially triangular shaped with a central liquid flow passage.

13. The invention as defined in claim 12 wherein said flow passage is substantially cylindrical.

14. The invention as defined in claim 12 wherein said liquid feed line extends through said central liquid flow passage to said first valve means.

15. The invention as defined in claim 2 wherein said surface cleaning device includes a side opening and said feed line extends through said side opening to said first valve means.

16. The invention as defined in claim 1 wherein said first valve means additionally includes a liquid shut off means for terminating the flow of liquid therethrough when said liquid level control and safety fill system is removed from said reservoir and placed on a suport surface.

17. The invention as defined in claim 1 wherein said liquid level control and safety fill system is positioned within a closed container and a reservoir liquid level sensing line is connected to said closed container in a manner so as to establish a level of liquid in said closed container substantially equal to the level in said reservoir.

18. The invention as defined in claim 1 wherein when said float valve means is in said open state said liquid flows upward toward said second valve means which produces an audible sound indicating said first valve means is in an open state.

* * * * *